US005996215A

United States Patent [19]

Yamazoe et al.

[11] Patent Number: 5,996,215

[45] Date of Patent: Dec. 7, 1999

[54] METHOD OF MANUFACTURING A SURFACE-MOUNTABLE SWITCH HAVING AN OPENING COMPLETELY SEALED BY A TAPE SEAL

[75] Inventors: Eiji Yamazoe, Kawasaki; Hajime Okada, Tokyo, both of Japan

[73] Assignee: Fujitsu Limited, Kawasaki, Japan

[21] Appl. No.: 08/941,483

[22] Filed: Oct. 1, 1997

Related U.S. Application Data

[62] Division of application No. 08/529,783, Sep. 18, 1995, abandoned.

[30] Foreign Application Priority Data

Dec. 1, 1994 [JP] Japan ..... 6-298559

[51] Int. Cl.[6] ..... H01H 11/00

[52] U.S. Cl. ..... 29/622; 29/DIG. 44; 156/152; 156/286; 156/307.7

[58] Field of Search ..... 29/622, DIG. 44; 156/152, 286, 307.7

[56] References Cited

U.S. PATENT DOCUMENTS

| | | | |
|---|---|---|---|
| 4,773,155 | 9/1988 | Buchien | 29/622 |
| 4,841,109 | 6/1989 | Sakakino et al. | 200/302.1 |
| 5,080,155 | 1/1992 | Crozier | 200/302.2 X |
| 5,138,518 | 8/1992 | Schmertmann et al. | 200/302.1 X |

FOREIGN PATENT DOCUMENTS

| | | | |
|---|---|---|---|
| 3838842 | 8/1989 | Germany | 200/302.1 |

*Primary Examiner*—P. W. Echols

*Attorney, Agent, or Firm*—Nikaido, Marmelstein, Murray & Oram LLP

[57] ABSTRACT

An opening which leads inside a surface-moutable switch is sealed by a tape seal, a good seal being maintained even when heat is applied to the switch. A switch body has a top surface and an inner space in which an electrical contact is provided. A switch knob operating the electrical contact provided inside the switch is accessed through the opening. The tape seal seals the opening with an adhesive applied between the tape seal and a top surface of a switch body. A portion of the tape seal directly above the opening is drawn into the opening by a negative pressure in the opening. The surface-mountable switch is manufactured by placing the switch body applied with the tape seal in a vacuum chamber so as to evacuate air surrounding the switch body. The seal for the opening is temporarily broken by an air pressure inside the opening, and the pressure inside the opening becomes a negative pressure with respect to the atmospheric pressure. The portion of the tape seal directly above the opening is drawn into the opening. The switch body applied with the tape seal may be simply heated so that the air inside the opening is expanded. The expanded air is abruptly discharged through an air vent opening formed between the tape seal and the switch body. A negative pressure is generated in the opening to draw the tape seal into the opening, and the opening is hermetically sealed.

9 Claims, 15 Drawing Sheets

METHOD OF MANUFACTURING A SURFACE-MOUNTABLE SWITCH HAVING AN OPENING COMPLETELY SEALED BY A TAPE SEAL

This is a division of application Ser. No. 08/529,783 filed Sep. 18, 1995.

BACKGROUND OF THE INVENTION

1) Field of the Invention

The present invention generally relates to a switch which is surface-mountable on a circuit board and, more particularly, to a surface-mountable switch having an opening sealed with a tape seal to prevent invasion of a cleaning liquid into an inner space when the switch is subjected to a cleaning process and a manufacturing method of such a switch.

A small switch is mounted on a circuit board provided in electronic equipment such as a computer so as to switch an operational mode of the electronic equipment. Such a switch is surface-mounted on the circuit board. A switch knob for operating the switch is normally exposed outside from an opening formed on a top surface of the switch.

The switch is soldered onto the circuit board together with other electronic parts such as semiconductor devices by means of a solder reflowing process. The circuit board is subjected to a cleaning process after the reflowing process so as to remove a flux adhering on the circuit board. Since the semiconductor devices are completely sealed by a plastic molding, the semiconductor devices are not affected by the cleaning liquid when the circuit board is dipped into the cleaning liquid. However, since the above-mentioned switch has the opening for the switch knob, the cleaning liquid may invade into an inner space of the switch through the opening. If the cleaning liquid enters inside the switch, it may cause a corrosion of materials inside the switch and result in a bad electrical contact of the switch. Accordingly, in order to prevent the invasion of the cleaning liquid when the cleaning liquid is splashed on the switch, a tape seal is provided to cover the opening formed in the switch.

2) Description of the Related Art

FIGS. 1A and 1B show a small slide switch 1 (hereinafter referred to as a switch 1) which is surface-mounted on a circuit board of an electronic equipment. The switch 1 comprises a switch body 4 which includes a lower base 2 and an upper cap 3. A switch knob 5 is slidably provided inside the switch body 4. Leads 6 and 7 made of an electrically conductive material are provided on the lower base 2. Brushes 8*a* and 8*b* made of an electrically conductive material are attached on a bottom surface of the switch knob 5. The brushes 8*a* and 8*b* are electrically connected to each other.

An operational part 5*a* formed on a top surface of the switch knob 5 is exposed to the outside from an opening 9 formed in the upper cap 3. When the switch knob 5 is moved in directions indicated by arrows A1 and A2 in FIG. 1B via the operational part 5*a*, the switch knob 5 slides in the switch body 4. Accordingly, the brushes 8*a* and 8*b* attached on the switch knob 5 are moved to electrically connect or disconnect the leads 6 and 7.

Since the switch 1 is to be surface-mounted on a circuit board with other electronic parts, the leads 6 and 7 together are formed in a gull-wing shape. The switch 1 is mounted by means of a solder reflowing process, and thus a flux remaining on the circuit board must be removed, after the reflowing process, by a cleaning treatment which uses a cleaning liquid. Since the switch 1 has the opening 9 for the switch knob 5, the cleaning liquid may enter inside the switch body 4 if no measures is taken.

In order to prevent the invasion of the cleaning liquid into the switch body 4, a tape seal 10 is applied on a top surface of the switch 1 so as to cover the opening 9 as shown in FIG. 2. Conventionally, the tape seal 10 adheres onto the top surface of the switch body 4 by a thermal curing type adhesive 11. The adhesive 11 is applied on the top surface of the switch body 4 beforehand, and then the tape seal 10 is put on the top surface of the switch body 4 with the adhesive 11 therebetween under atmospheric pressure. The adhesive 11 is cured by applying heat to secure the adhesion of the tape seal 10 to the switch body 4.

The above-mentioned process for applying the tape seal 10 is performed at an end of a manufacturing process of the switch 1. Accordingly, the switch 1 is soldered onto the circuit board in a state where the tape seal 10 is applied.

In a state in which the opening 9 is covered by the tape seal, an inner space 12 (refer to FIG. 2) formed between the lower base 2 and the upper cap 3 is hermetically sealed. Accordingly, when the switch 1 is heated in a heating process for soldering, air in the inner space 12 is expanded by heat. Accordingly, air pressure in the inner space 12 is increased, and thereby the tape seal 10 is pressed from inside by the thermal expansion of the air. This may cause, in a worst case, a breakage of adhesion of the tape seal 10 as shown in FIG. 3 which release the air confined in the inner space 12. This results in an incomplete seal of the opening 9 due to an opening or a hole formed between the tape seal 10 and the top surface of the switch body 4. It should be noted that FIG. 3 shows the switch 1 mounted on a circuit board 14 by a solder 15 applied to the end of each of the leads 7 and 8.

When there is formed the above-mentioned opening or hole, there is a problem in that the cleaning liquid enters into the inner space 12 during the cleaning process, and thus a bad electrical contact and a corrosion of materials in the inner space 12 occur.

SUMMARY OF THE INVENTION

It is a general object of the present invention to provide an improved and useful surface-mountable switch and a manufacturing method thereof in which the above-mentioned problems are eliminated.

A more specific object of the present invention is to provide a surface-mountable switch having an opening which leads inside the switch and is hermetically sealed by a tape seal, a good seal being maintained even when heat is applied to the switch.

Another object of the present invention is to provide a manufacturing method of a surface-mountable switch an opening of which is hermetically sealed by a tape seal, a good seal being maintained even when air in a space formed inside the switch is expanded by heat.

In order to achieve the above-mentioned objects, there is provided according to one aspect of the present invention a surface-mountable switch which is surface-mounted onto a circuit board by reflowing of solder, the surface-mountable switch comprising:

a switch body having a top surface and an inner space in which an electrical contact is provided, the inner space being communicated with an opening formed in the top surface, a switch knob which operates the electrical contact being accessed through the opening; and a tape seal hermetically sealing the opening with an adhesive applied between the tape seal and the top surface of the switch body, a portion of the tape seal directly above the opening being drawn into the opening by a negative pressure in the opening and the inner space.

Preferably, the adhesive detachably adheres the tape seal onto the top surface of the switch body so that the tape seal can be peeled off after a cleaning process applied to the circuit board has completed.

Additionally, there is provided according to another aspect of the present invention a manufacturing method of the above-mentioned kind of surface-mountable switch in which manufacturing method the switch body applied with the tape seal is placed in a vacuum chamber so as to evacuate air surrounding the switch body. The seal between the tape seal and the top surface of the switch body is temporarily broken by an air pressure inside the opening covered by the tape seal, and an air vent opening is formed between the tape seal and the top surface of the switch body. The air vent opening closes immediately after the air in the opening and the inner space is evacuated. Accordingly, the pressure inside the opening and the inner space becomes a negative pressure with respect to the atmospheric pressure. Thus, the portion of the tape seal directly above the opening is drawn into the opening.

Additionally, there is provided according to another aspect of the present invention a manufacturing method of the above-mentioned kind of surface-mountable switch in which manufacturing method the switch body applied with the tape seal is heated. The air inside the opening and the inner space is expanded by heat and, thus, the portion of the tape seal directly above the opening is inflated by the expanded air. The expanded air is abruptly discharged through an air vent opening formed between the tape seal and the top surface of the switch body. Thus, a negative pressure is generated in the opening and the inner surface, and thereby the tape seal is drawn into the opening and the tape seal securely adheres onto the top surface of the switch body so that the opening is hermetically sealed.

Other objects, features and advantages of the present invention will become more apparent from the following description when read in conjunction with the accompanying drawings.

DETAILED DESCRIPTION OF THE PREFERRED EMBODIMENTS

A description will now be given, with reference to FIGS. 4 and 5, of an embodiment of a surface-mountable switch according to the present invention. In this embodiment, a small slide switch 20 is used as an example of a surface-mountable switch according to the present invention. However, the present invention is not limited to the small slide switch 20, and is applicable to other kinds of switches which are surface-mounted to a circuit board.

Figure 1:
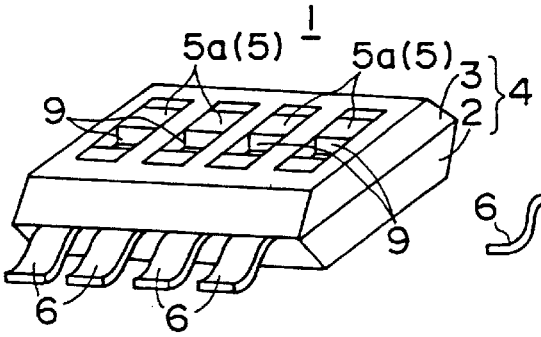
F I G. 1 A PRIOR ART
FIG. 1A is a perspective view of a conventional surface-mountable switch.
FIG. 1B is a cross-sectional view of the surface-mountable switch shown in FIG. 1A.
Figure 1:
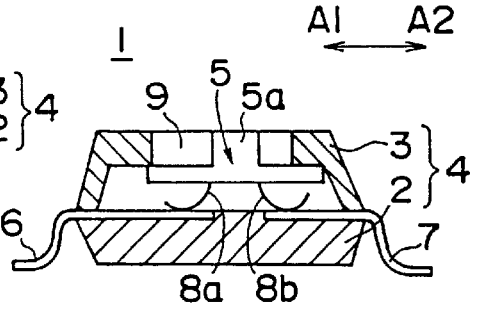
F I G. 1 B PRIOR ART
Figure 2:
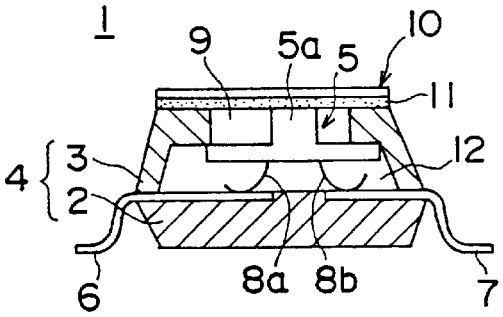
F I G. 2 PRIOR ART
FIG. 2 is a cross-sectional view of the surface-mountable switch shown in FIG. 1A to which a tape seal is applied to seal an opening formed therein by a conventional method;.
Figure 3:
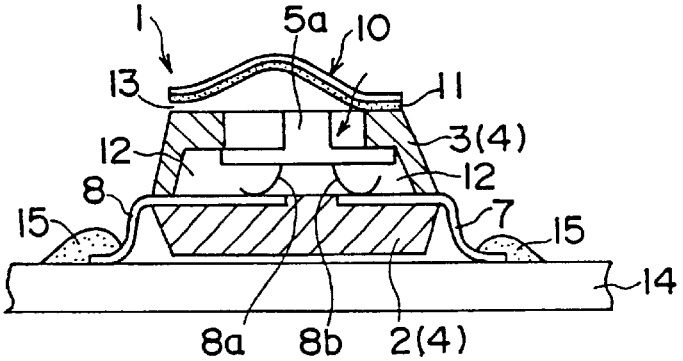
F I G. 3 PRIOR ART
FIG. 3 is a cross-sectional view of the surface-mountable switch shown in FIG. 2 in a state in which the tape seal is lifted by an air pressure.
Figure 4:
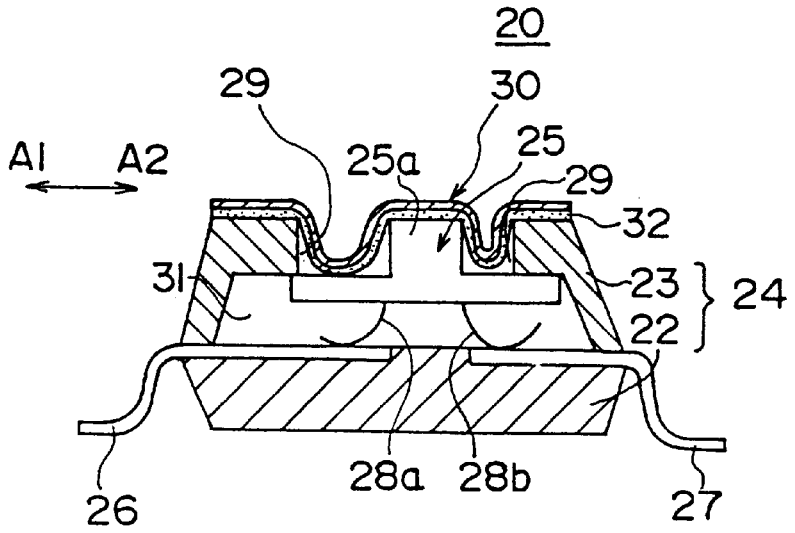
FIG. 4 is a cross-sectional view of a switch according to an embodiment of a switch of the present invention.
Figure 5:
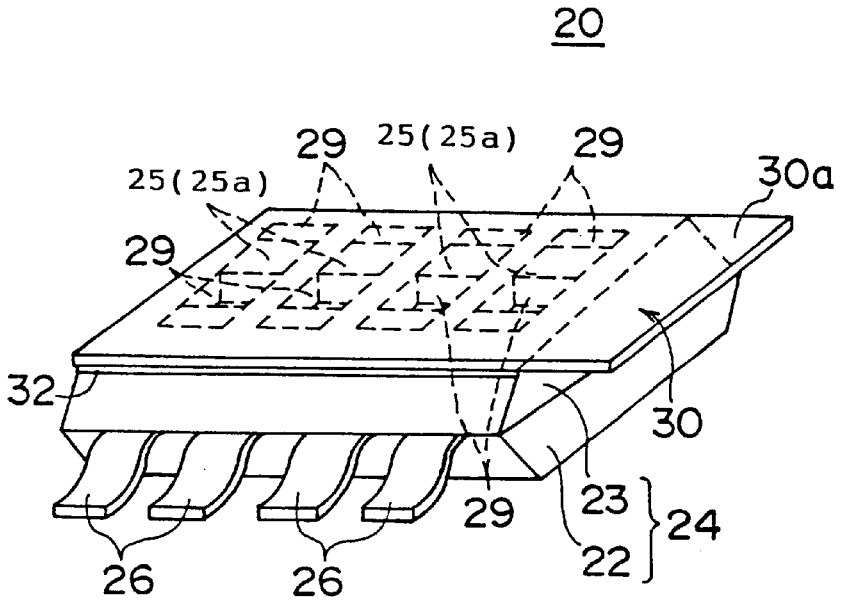
FIG. 5 is a perspective view of the switch shown in FIG. 4.

FIG. 4 is a cross-sectional view of the switch 20, and FIG. 5 is a perspective view of the switch 20. The switch 20 comprises a switch body 24 which includes a lower base 22 and an upper cap 23 which are made of a hard plastic. A switch knob 25 made of a plastic is slidably provided inside the switch body 24. In this embodiment, the switch 20 has four switch knobs 25.

Leads 26 and 27, which are made of an electrically conductive metal, are provided on the lower base 22 by means of insert molding. Brushes 28*a* and 28*b*, which are made of an electrically conductive material, are provided on the switch knob 25. The brushes 28*a* and 28*b* are electrically connected to each other.

An operational part 25*a* is formed on an upper part of the switch knob 25. The operational part 25*a* is exposed to the outside from an opening 29 formed in the upper cap 23. Accordingly, when the switch knob 25 is moved in directions indicated by arrows A1 and A2 in FIG. 4 via the operational part 25*a*, the switch knob 25 slides in the switch body 24. Thus, the brushes 28*a* and 28*b* attached on the switch knob 25 are moved to electrically connect or disconnect the leads 26 and 27.

Since the switch 20 is to be surface-mounted on a circuit board with other electronic parts, the leads 6 and 7 together are formed in a gull-wing shape. The switch 20 is mounted by a solder reflowing process, and thus a flux remaining on the circuit board must be removed, after the solder reflowing process, by a cleaning treatment which uses a cleaning liquid. Since the switch 20 has the opening 29 for the switch knob 5 and a gap exists between the switch knob 25 and upper cap 23, the cleaning liquid may enter inside the switch body 24 if no measures are taken.

In order to prevent the invasion of the cleaning liquid into the switch body 24, a tape seal 30 is applied on a top surface of the switch 20 so as to cover the opening 29. The tape seal 30 is made of a plastic such as polyimide or nylon. The tape seal 30 adheres onto the top surface of the upper cap 23 of the switch body 24 by an adhesive 32 as shown in FIG. 4. The tape seal 30 is placed on the top surface of the upper cap 23 of the switch body 24 with the adhesive 32 therebetween. The adhesive 32 is so selected that the tape seal 32 is easily peeled off from the switch body 24 when it is no longer needed.

In this embodiment, the tape seal 30 adheres onto the switch body 24 in a state in which an air pressure in an inner space 31 formed between the upper cap 23 and the lower base 22 is a negative pressure relative to the atmospheric pressure. Accordingly, a portion of the tape seal 30 directly above the opening 29 is drawn into the opening 29 under the atmospheric pressure as shown in FIG. 4. In the above-mentioned construction of the switch 20, when heat is applied to the switch 20 during a soldering process, the air in the inner space 31 does not excessively press the tape seal 30 from inside. Accordingly, an invasion of the cleaning liquid into the inner space 31 during the succeeding cleaning process is prevented. This prevents a bad electric contact and a corrosion of a material in the inner space 31 which may be caused by the invasion of the cleaning liquid. Therefore, the reliability of the switch 20 is improved.

It should be noted that the tape seal 30 is peeled off from the switch body 24 after the cleaning process so that the operational part 25*a* of the switch knob 25 can be accessed to operate the switch 20. The peeling of the tape seal 30 is easy because the adhesion force of the adhesive 32 is so selected that an appropriate adhesion force is provided. Additionally, an end of the tape seal 30 is extended to provide an extending portion 30*a* as shown in FIG. 5 so that the extending portion 30*a* is conveniently pulled when a peeling operation for the tape seal 30 is performed.

A description will now be given, with reference to FIGS. 6 to 9, of a first embodiment of a manufacturing method of the switch 20 according to the present invention. In FIGS. 6 to 9, parts that are the same as the parts shown in FIG. 4 are given the same reference numerals, and descriptions thereof will be omitted. It should be noted that the manufacturing method of the switch 20 before the process for applying the tape seal 30 is the same as that of the conventional switch, and thus descriptions thereof will be omitted.

Figure 6:
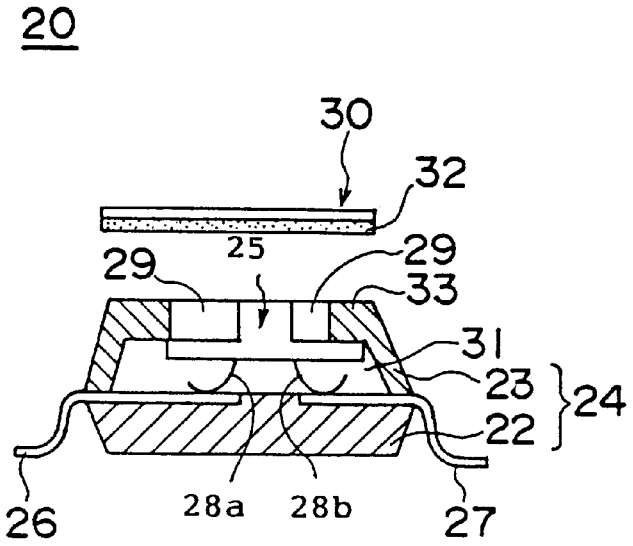
FIGS. 6 to 9 are views for explaining a first embodiment of a manufacturing method of the switch shown in FIG. 4.
Figure 7:
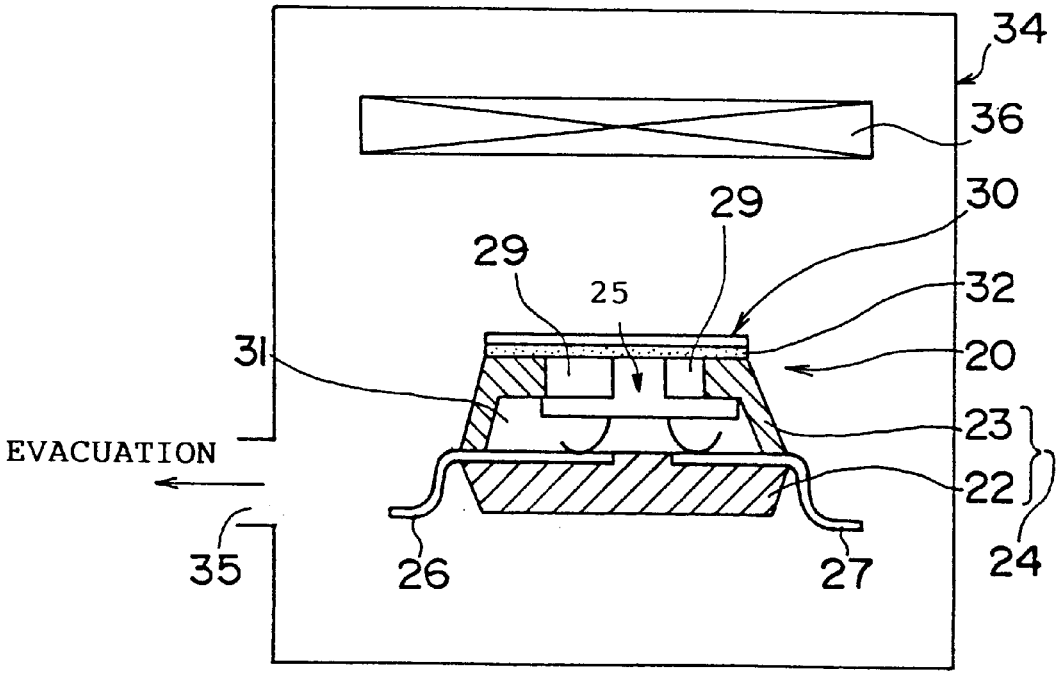

In this embodiment, the tape seal 30 is applied onto the switch body 24 first. FIG. 6 shows the process for applying the tape seal 30. In the process for applying the tape seal 30, the tape seal 30 applied with the adhesive 32 is placed onto the top surface 33 of the upper cap 23 of the switch body 24 under atmospheric pressure so as to cover opening 29 formed in the top surface 33. The adhesive 32 is a thermal curing type adhesive. Accordingly, an air pressure in the opening 29 and the inner space 31 is equal to the atmospheric pressure when the tape seal 30 is put on the top surface 33 with the adhesive 32 therebetween. Since no heat is applied in this process, the adhesive 32 has not been cured yet.

After the process for applying the tape seal 30, the switch body 24 is placed in a vacuum chamber 34. The vacuum chamber 34 has an evacuation port 35 connected to a vacuum pump not shown in the figures. Additionally, a heating apparatus 36 is provided in the vacuum chamber 34 so as to apply heat to the adhesive 32. The heating apparatus 36 may be an electric heater which can generate heat sufficient to cure the adhesive 32.

Figure 8:
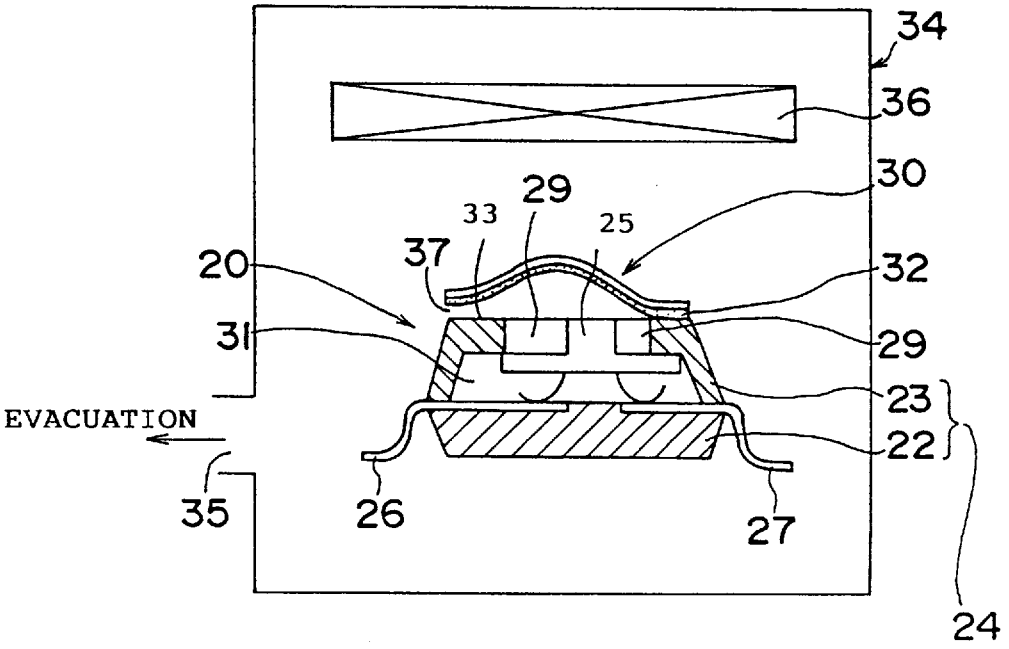

After the switch body 24 applied with the tape seal 30 is placed in the vacuum chamber 34, air in the vacuum chamber 34 is evacuated through the vacuum port 35 by the vacuum pump, and heat is applied to the tape seal 30 by the heating apparatus 36. At an initial stage of the evacuation, the pressure in the vacuum chamber 34 is decreased while the air pressure in the inner space 31 of the switch body 24 is maintained at the atmospheric pressure. Accordingly, the tape seal 30 is inflated by the air inside the opening 29 and the inner space 31 and, eventually, a portion of the tape seal 30 is lifted or separated off from the top surface 33 of the switch body 24 which forms an air vent opening or a hole 37 between the top surface 33 of the upper cap 23 of the switch body 24 and the tape seal 30 as shown in FIG. 8. Accordingly, the air in the opening 29 and the inner space 31 is abruptly discharged outside so that the pressure in the inner space 31 becomes equal to the negative pressure in the vacuum chamber 34.

After the air in the opening 29 and the inner space 31 is evacuated, the tape seal 30 tends to return to its original flat shape, and thus the opening or the hole 37 is closed. At this time, since the tape seal 30 is heated by the heating apparatus 36, the tape seal 30 is softened and a portion of the tape directly above the opening 29 has been expanded due to the inflation by the air inside the opening 29. Accordingly, the portion of the tape seal 30 directly above the opening 29 is recessed into the opening 29. Additionally, since a negative pressure is temporarily generated in the opening 29 due to the abrupt discharge of the air, the portion of the tape seal 30 directly above the opening 29 is drawn into the opening 29.

Figure 9:
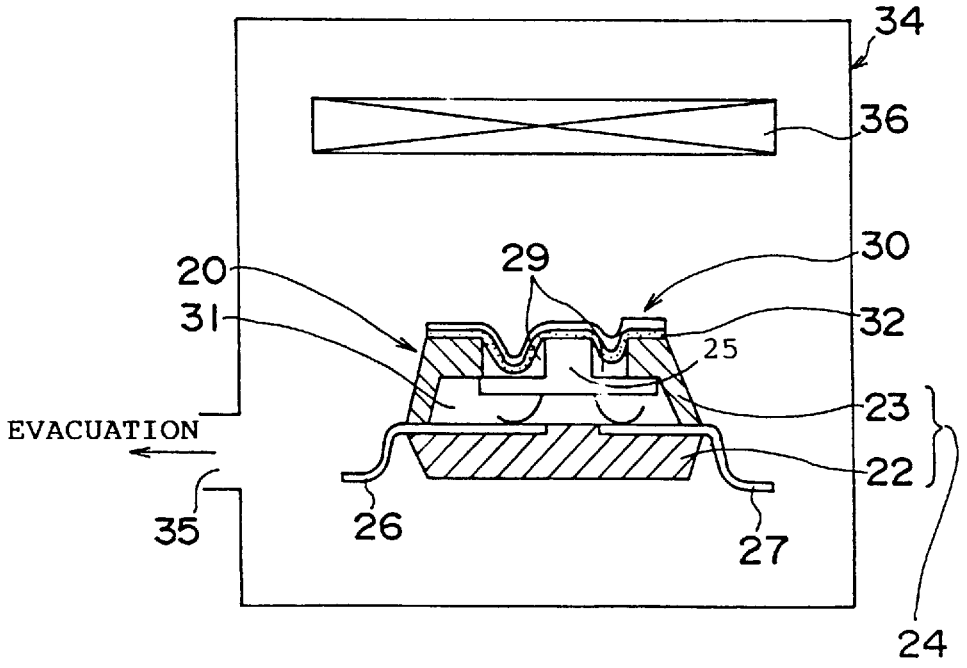

An amount of heat applied by the heating apparatus 36 is controlled so that the adhesive 32 is not cured until this stage is ended. Thus, the tape seal 30 adheres to the top surface 33 again. Thereafter, the heating of the tape seal 30 is continued to completely cure the adhesive 32. Accordingly, when the adhesive 32 is cured, the inner space 31 is hermetically sealed with a negative pressure inside. FIG. 9 shows a state in which the adhesive 32 is completely cured and the opening 29 is hermetically sealed by the tape seal 30.

When the switch body 24 is taken out of the vacuum chamber 34, the tape seal 30 is drawn further into the opening 29 since the opening 29 and the inner space 31 are at a negative pressure relative to the atmospheric pressure. Since the air pressure in the opening 29 and the inner space 31 is negative and the tape seal 30 is drawn or pushed into the opening 29, the tape seal 30 is not greatly inflated as it is in the tape seal applied by the conventional method when heat is applied in the succeeding soldering process. This prevents a breakage of the adhesion of the tape seal 30, and thus the invasion of the cleaning liquid is prevented.

Additionally, since the evacuation of the vacuum chamber 34 and the heating of the tape seal 30 is simultaneously performed, a manufacturing process time is reduced as compared to the conventional manufacturing process in which those two processes are performed separately.

A description will now be given, with reference to FIGS. 10 to 13, of a second embodiment of a manufacturing method of the switch 20 according to the present invention. In FIGS. 10 to 13, parts that are the same as the parts shown in FIG. 4 are given the same reference numerals, and descriptions thereof will be omitted.

In this embodiment, the tape seal 30 is applied onto the top surface 33 of the upper cap 23 in a vacuum chamber 38. Similarly to the above-mentioned embodiment, the vacuum chamber 38 has an evacuation port 35 which is connected to a vacuum pump not shown in the figures. A tape seal applying apparatus 39 is provided in the vacuum chamber 38 so as to apply the tape seal 30 in the vacuum chamber 39.

Figure 10:
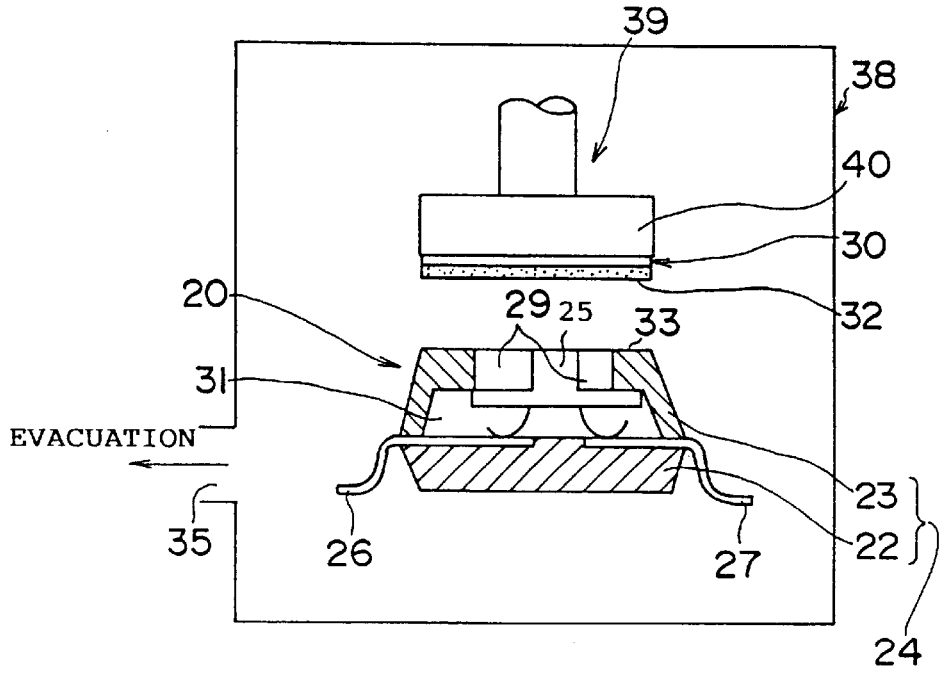
FIGS. 10 to 13 are views for explaining a second embodiment of a manufacturing method of the switch shown in FIG. 4.

In this embodiment, as shown in FIG. 10, the switch 20 is placed first in the vacuum chamber 38 without the tape seal 30. Air in the vacuum chamber 38 is then evacuated. Accordingly, air in the inner space 31 of the switch body 24 is also evacuated since there is a gap between the switch knob 25 and the upper cap 23. That is, the air pressure in the inner space 31 is decreased as the air pressure in the vacuum chamber 38 is decreased.

When the air pressure in the vacuum chamber 38 reaches a predetermined negative pressure, the tape seal applying apparatus 39 is operated to apply the tape seal 30 onto the top surface 33 of the upper cap 23 of the switch body 24. In this embodiment, a stamp-type machine using a stamp shaft 40 is used as the tape seal applying apparatus 39. However, other types of machines may be used instead of the stamp-type machine.

Figure 11:
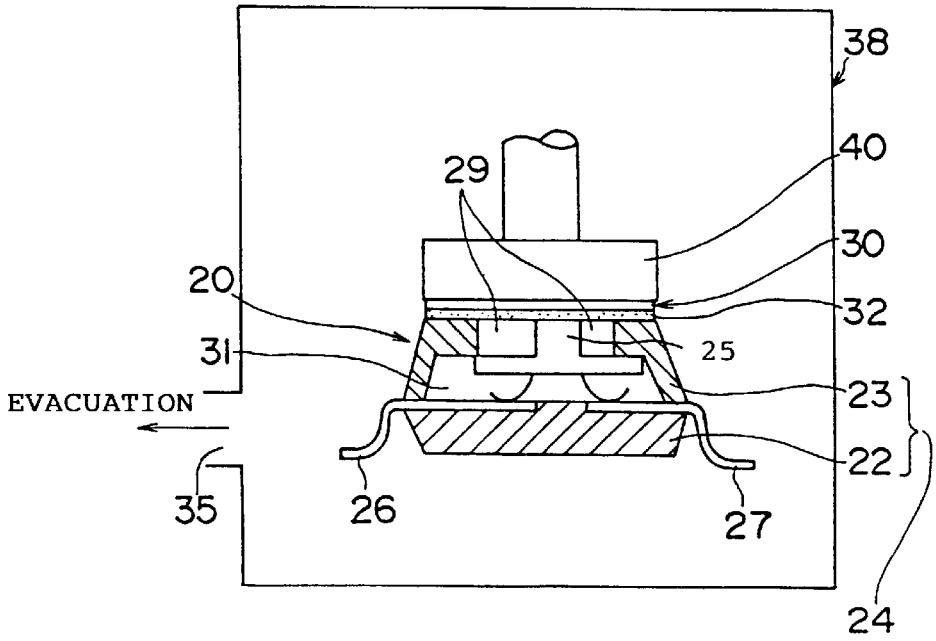

As mentioned-above, after the pressure in the vacuum chamber 36 has reached a predetermined negative pressure and when an operation of the tape seal applying apparatus 39 is started, the stamp shaft 40 moves downwardly to press the tape seal 30 onto the top surface 33 of the upper cap 23 as shown in FIG. 11. Since the adhesive 32 is applied to the tape seal 30 beforehand, the tape seal 30 adheres onto the top surface 33 of the upper cap 23 by the adhesive 32.

Figure 12:
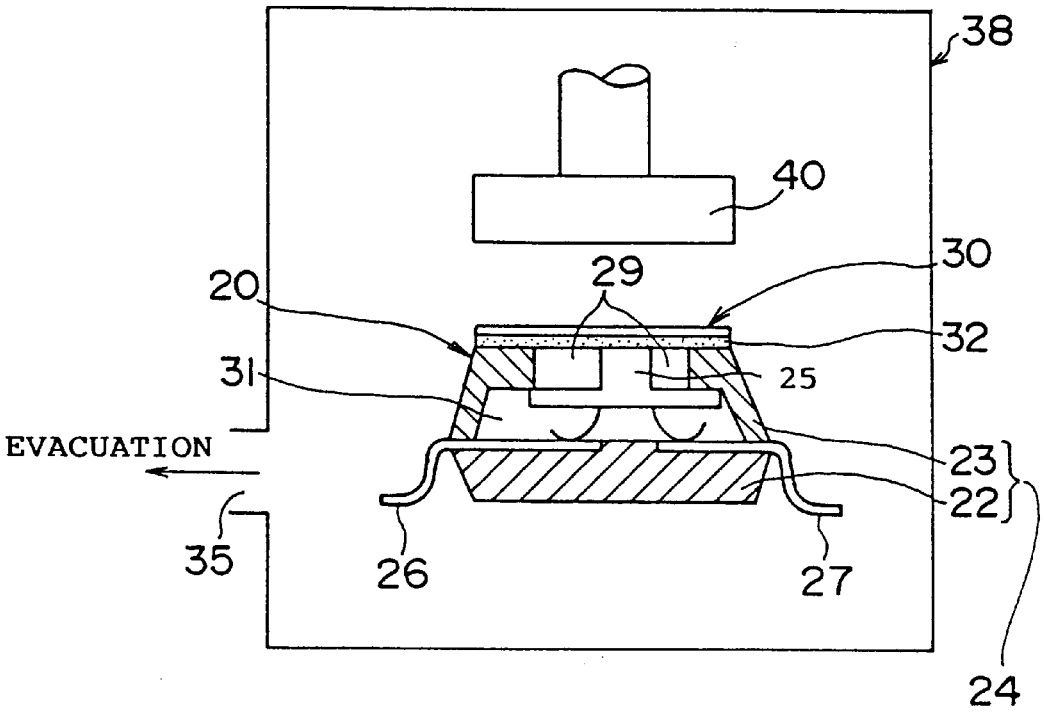

After the tape seal 30 securely adheres onto the top surface 33, the stamp shaft 40 is moved upwardly to release a pressing force to the tape seal 30. At this time, since the pressure in the vacuum chamber 38 is still maintained at the predetermined negative pressure, the tape seal 30 is maintained to be flat as shown in FIG. 12.

Figure 13:
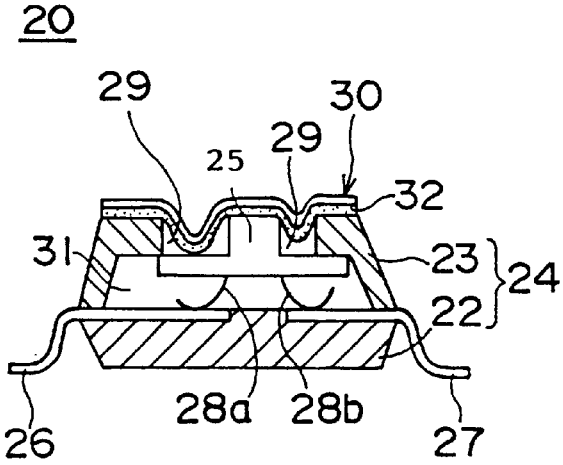
Figure 14:
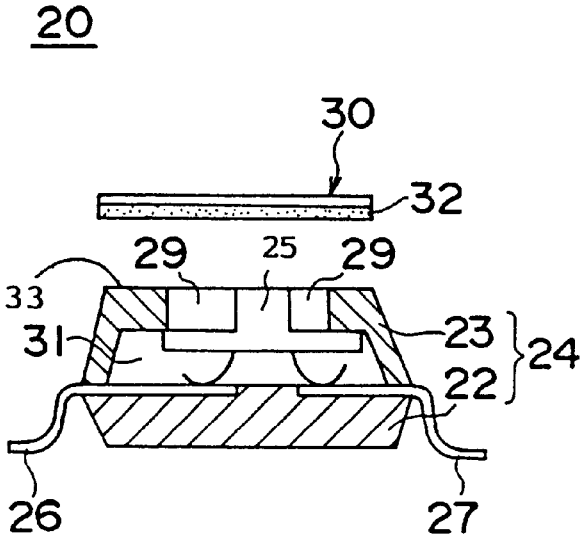
FIGS. 14 to 20 are views for explaining a third embodiment of a manufacturing method of the switch shown in FIG. 4.

However, when the switch 20 is taken out from the vacuum chamber 38, the atmospheric pressure is applied onto the tape seal 30 and the pressure inside the opening 29 is maintained at the predetermined negative pressure, a portion of the tape seal 30 covering the opening 29 is pushed into the opening 29 as shown in FIG. 13. Thus, the switch 20 having the same construction as that shown in FIG. 4 is manufactured by the present embodiment.

According to the present embodiment, since the air pressure in the opening 29 and the inner space 31 is the negative pressure, the tape seal 30 is not excessively expanded when heat is applied in a succeeding process. Thus, the inner space is hermetically sealed with the tape seal 30 during the cleaning process, and the cleaning liquid does not enter into the inner space 30. The manufacturing method of this embodiment is simple since the tape seal 30 simply adheres onto the top surface 33 under a negative pressure. Additionally, the adhesive 32 used in this embodiment is not limited to the thermal curing type adhesive, and thus a low-cost adhesive can be selected. Additionally, a severe thermal characteristic is not required for the tape seal 30 since heat is not applied for curing the adhesive 32.

A description will now be given, with reference to FIGS. 14 to 20, of a third embodiment of a manufacturing method of the switch 20 according to the present invention. In FIGS. 14 to 20, parts that are the same as the parts shown in FIG. 4 are given the same reference numerals, and descriptions thereof will be omitted.

Figure 15:
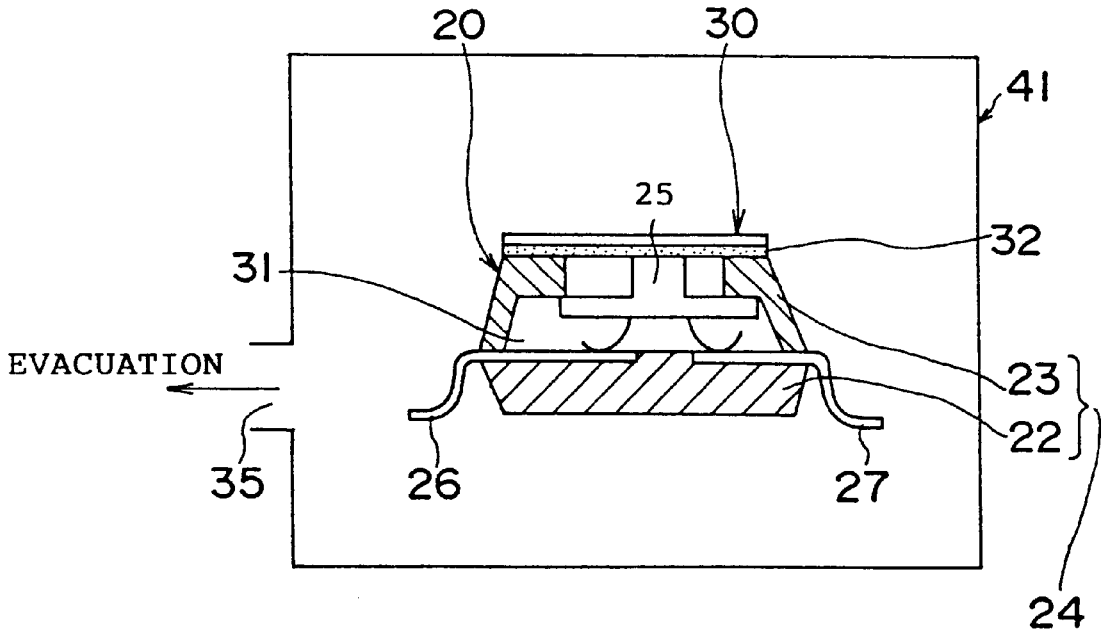
Figure 16:
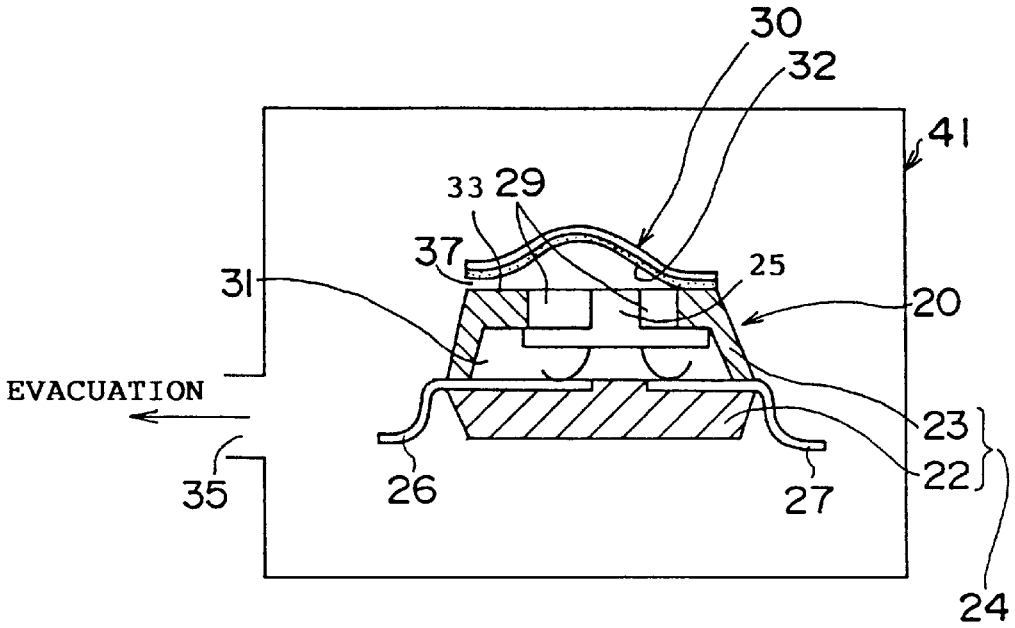

In this embodiment, the tape seal 30 is applied onto the top surface 33 of the upper cap 23 under atmospheric pressure. In a state in which the tape seal 30 is applied onto the switch body 24, the inner space 31 is filled with air under atmospheric pressure. Since a heating operation is not performed at this stage, the adhesive 32 has not been cured yet. After the tape seal applying process is completed, the switch body 24 having the tape seal 30 attached thereon is placed in a vacuum chamber 41 as shown in FIG. 15. Similarly to the above-mentioned embodiment, the vacuum chamber 41 has the evacuation port 35 which is connected to a vacuum pump not shown in the figures. Unlike the previously mentioned embodiments, a tape seal applying apparatus or a heating apparatus is not provided in the vacuum chamber 41. The switch 20 is subjected to simply an evacuation process in the vacuum chamber 41. The vacuum chamber 41 has a simple construction as compared to the vacuum chambers in the previously mentioned embodiments.

Figure 17:
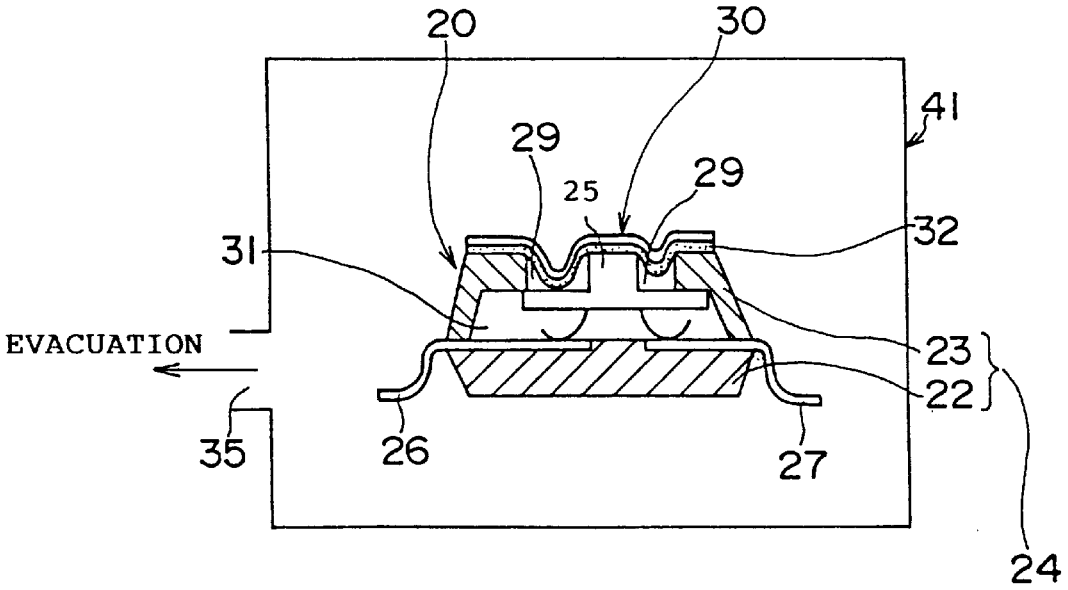

After the tape seal 30 adheres onto the upper surface 33 of the upper cap 23 of the switch body 24 and the switch body 24 is placed in the vacuum chamber 41, air in the vacuum chamber 41 is evacuated by the vacuum pump through the evacuation port 35. As the pressure in the vacuum chamber 41 is decreased, the pressure in the inner space 31 of the switch body is increased relative to the pressure of the air surrounding the switch body 24. Accordingly, a portion of the tape seal 30 directly above the opening 29 is pressed from inside and expanded by the air inside the opening 29 and the inner space 31. Eventually, a portion of the tape seal 30 is lifted from the top surface 33, and the air vent opening or the hole 37 is formed between the tape seal 30 and the top surface 33 of the upper cap 23. The air in the opening 29 and the inner space 31 is abruptly discharged from the air vent opening or the hole 37, and thus the tape seal 30 tends to return to its original flat shape. However, as previously explained, the portion of the tape seal 30 directly above the opening 29 is drawn into the opening 29. The pressure in the vacuum chamber 41 is then returned to the atmospheric pressure. Thus, the portion of the tape seal 30 directly above the opening 29 is pushed further into the opening 29 by the negative pressure in the opening 29 and the inner space 31 as shown in FIG. 17. Thereby, the tape seal 30 securely adheres onto the switch body 24 again by the adhesive 32 which has not been cured yet.

Figure 18:
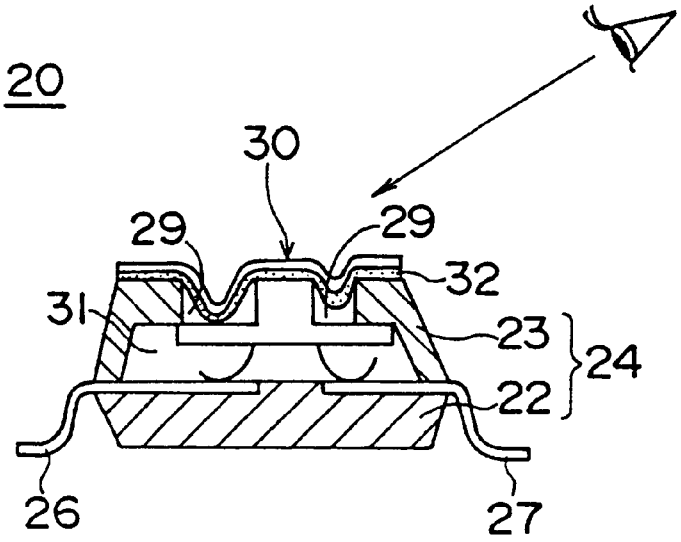

After the above-mentioned evacuation process is completed, the switch 20 is taken out from the vacuum chamber 41 and is subjected to an inspection process. In the inspection process, it is checked whether the opening or the hole 37 is completely closed by the tape seal 30. If the air vent opening or the hole 37 is not completely closed, the portion of the tape seal 30 directly above the opening 29 returns to an original flat shape after a certain duration since the pressure in the opening 29 and the inner space 31 returns to the atmospheric pressure and thus no pressing force is applied on the portion of the tape seal 30 directly above the opening 29. Accordingly, the inspection can be performed by visually checking the shape of the tape seal 30 directly above the opening 29 as shown in FIG. 18.

In the inspection process, if the portion of the tape seal 30 directly above the opening 29 is not pushed in to the opening 29 and is returned to its original flat shape, the particular switch 20 is rejected. Only the switch 20 passing the visual inspection is subjected to a subsequent heating process. In the heating process, heat is applied to the adhesive 32 so that the adhesive 32 is completely cured to ensure the hermetic seal of the opening 29 by the tape seal 30.

Figure 19:
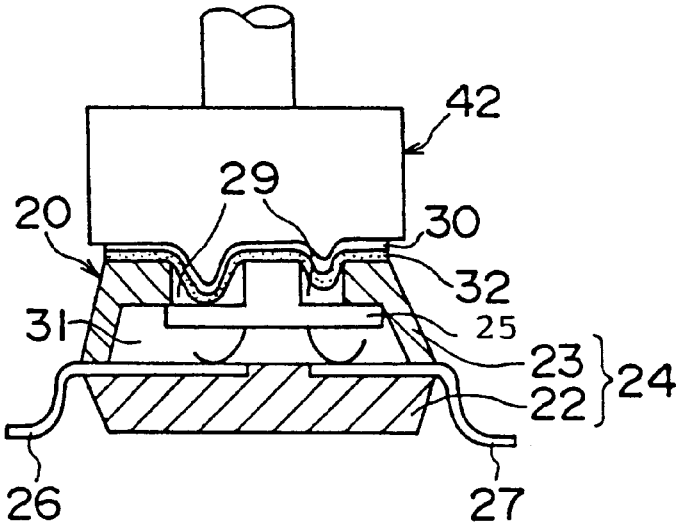
Figure 20:
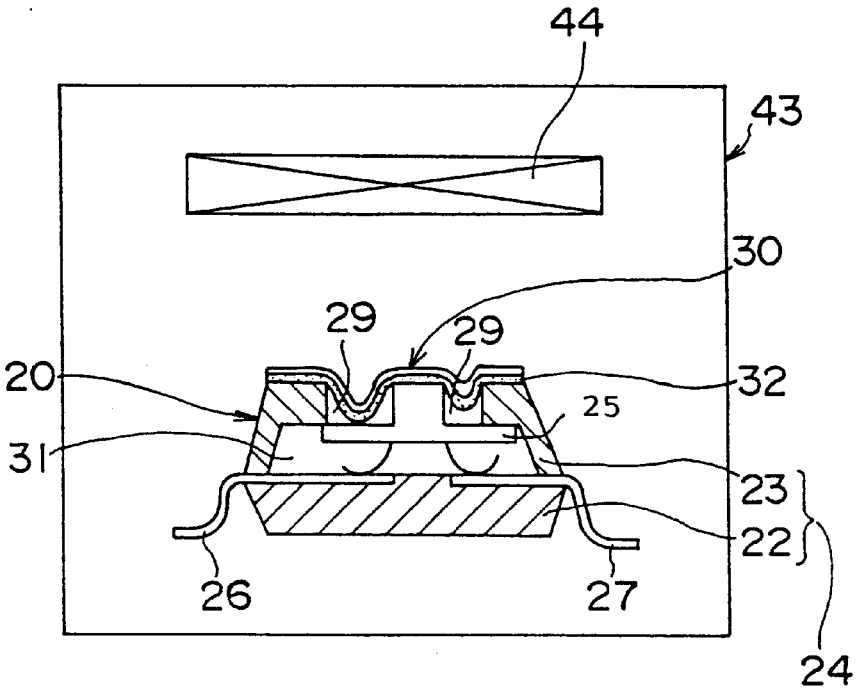

In the heating process of this embodiment, the tape seal 30 is pre-heated by a heat press apparatus 42 as shown in FIG. 19, and thereafter the switch 20 is placed in a heating chamber 43 as shown in FIG. 20. The pre-heating is performed for effectively heating the adhesive 32 to reduce a curing time.

According to the present embodiment, since the air pressure in the inner space 31 is a negative pressure, the tape seal 30 is not excessively expanded when heat is applied in the subsequent process. Thus, the inner space is hermetically sealed with the tape seal 30 during the cleaning process, and the cleaning liquid does not enter into the inner space 31.

Additionally, the heating process for curing the adhesive 32 is performed only on the switch 20 the opening 29 of which is completely sealed by the seal tape 30 and the adhesive 32 by rejecting any switch 20 found to be defective. Thus, a yield rate of the switch 20 is improved by performing the visual inspection on the seal tape 30.

A description will now be given, with reference to FIGS. 21 to 27, of a fourth embodiment of a manufacturing method of the switch 20 according to the present invention. In FIGS. 21 to 27, parts that are the same as the parts shown in FIG. 4 are given the same reference numerals, and descriptions thereof will be omitted.

Figure 21:
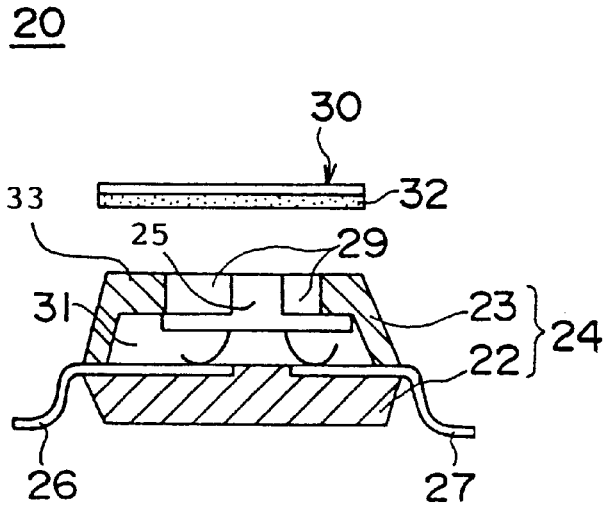
FIGS. 21 to 27 are views for explaining a fourth embodiment of a manufacturing method of the switch shown in FIG. 4.
Figure 22:
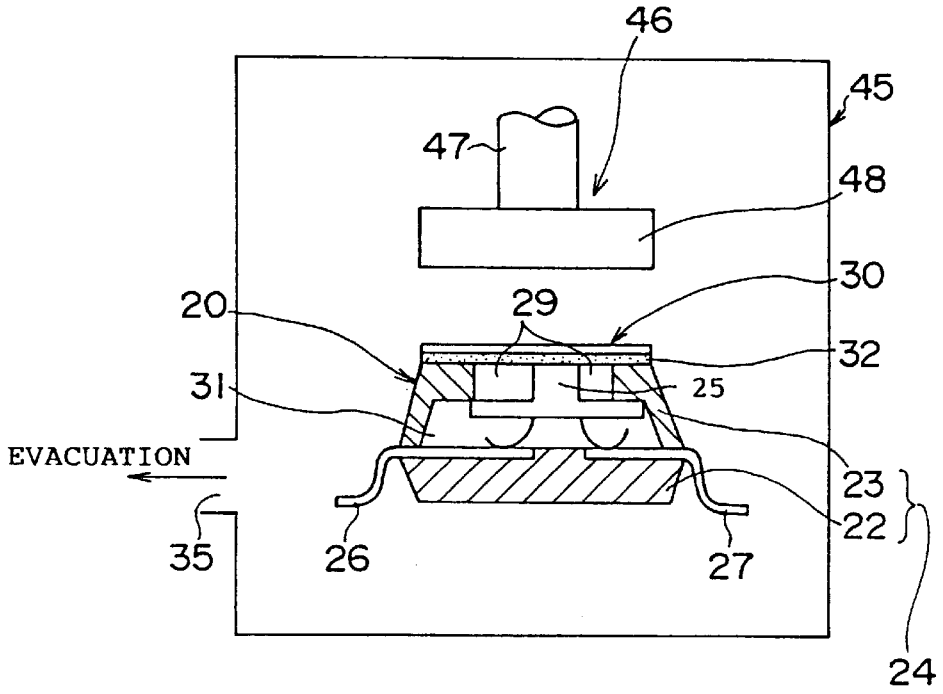

In this embodiment, the tape seal 30 is applied to the switch body 24 in the same process as that of the above-mentioned third embodiment. FIG. 21 shows the tape seal applying process. The switch 20 having the tape seal 30 is then placed in a vacuum chamber 45 as shown in FIG. 22. The vacuum chamber 45 has an evacuation port 35 which is connected to a vacuum pump not shown in the figures.

A pressing apparatus 46 is provided in the vacuum chamber 45. The pressing apparatus 46 comprises a shaft 47 and a pressing member 48 provided on a lower end of the shaft 47. The shaft 47 is moved upwardly and downwardly by a driving apparatus not shown in the figures. The pressing member 48 is formed of an elastic material such as silicon rubber so that the pressing member can be elastically deformed when it is pressed onto the tape seal 30.

Figure 23:
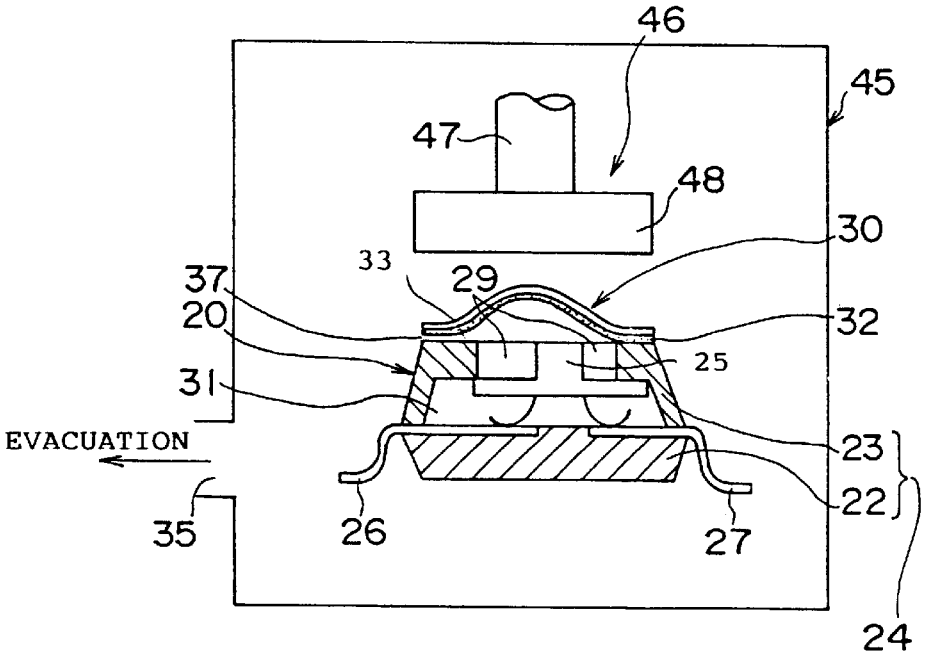
Figure 24:
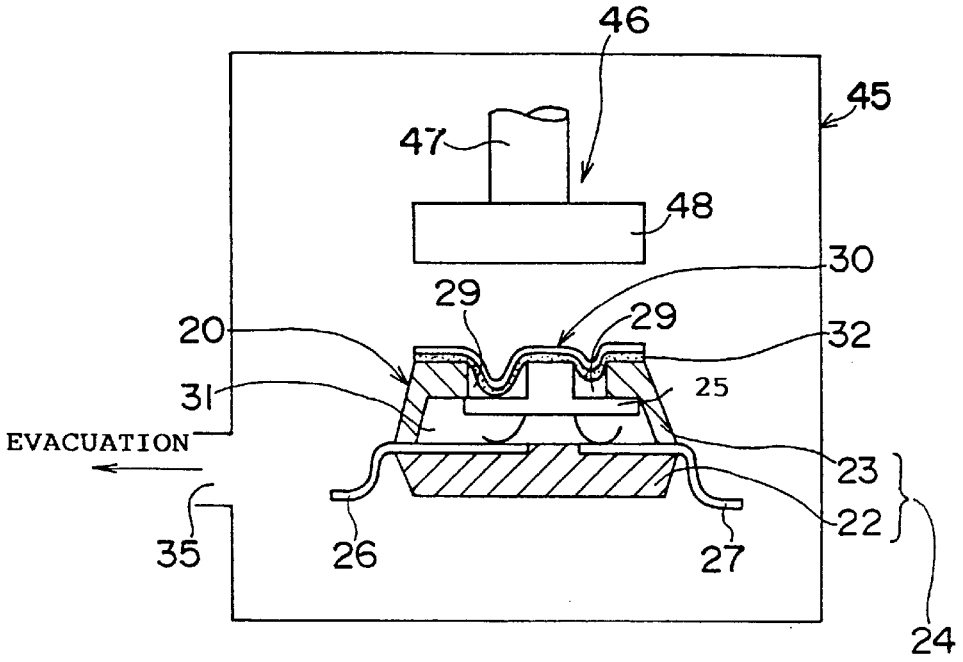
Figure 25:
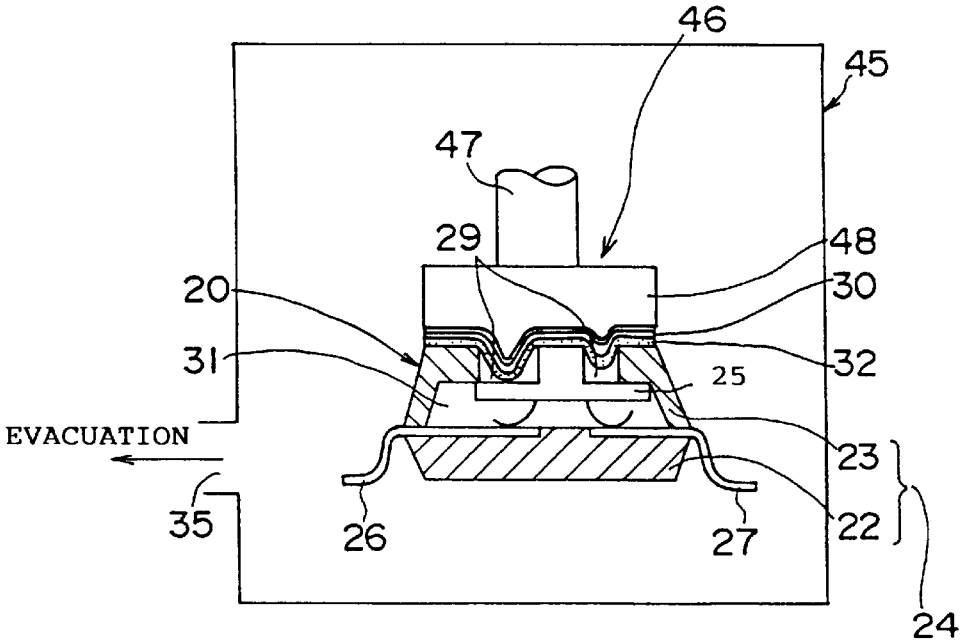

After the tape seal 30 adheres onto the top surface 33 of the upper cap 23 of the switch body 24 and the switch body 24 is placed in the vacuum chamber 45, air in the vacuum chamber 45 is evacuated by the vacuum pump. As the pressure in the vacuum chamber 45 is decreased, the relative pressure in the opening 29 and the inner space 31 of the switch body is increased with respect to the pressure of the air surrounding the switch body 24. Accordingly, a portion of the tape seal 30 directly above the opening 29 is pressed from inside and expanded by the air inside the opening 29 and the inner space 31. Eventually, a portion of the tape seal 30 is abruptly lifted from the switch body 24, and an opening or a hole 37 is formed between the tape seal 30 and the top surface 33 of the upper cap 23 as shown in FIG. 23. Air in the inner space 31 is abruptly discharged from the air vent opening or the hole 37, and thus the tape seal 30 tends to return to its original flat shape. Thus, the peeled portion of the tape seal 30 adheres onto the switch body 24 again as shown in FIG. 24, and thereby the air vent opening or the hole 37 is closed. Thereafter, the pressing member 48 is moved downwardly toward the tape seal 30 so that the tape seal 30 is pressed against the top surface 33 of the upper cap 23 as shown in FIG. 25. Thus, the tape seal 30 adheres securely onto the top surface 33 of the upper cap 23 of the switch body 24 and the opening or the hole 37 is completely closed. Additionally, since the pressing member 48 is made of an elastic material, the portion of the tape seal 30 covering the opening 29 is pressed further down into the opening 29. Accordingly, in this embodiment, an occurrence of a defective switch with respect to the seal of the tape seal 30 is decreased, and thus a yield rate of the switch 20 is improved.

Figure 26:
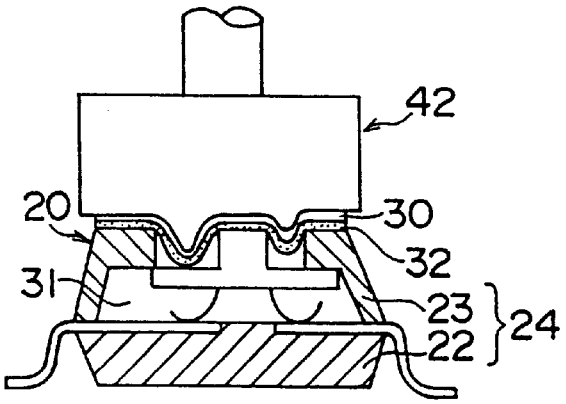
Figure 27:
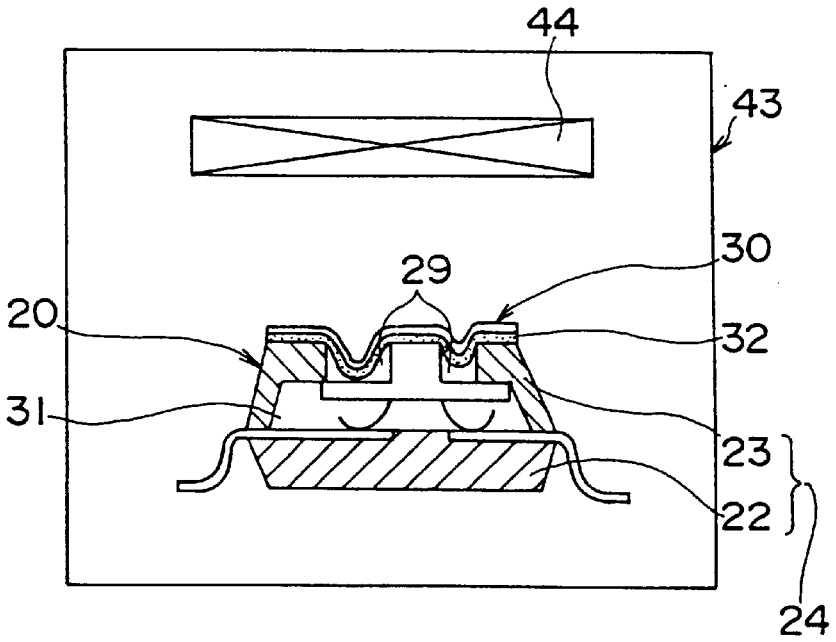

After the process for pressing the tape seal 30 is completed, the switch 20 is taken out from the vacuum chamber 45, and then a heating process for curing the adhesive 32 is performed as shown in FIGS. 26 and 27. The heating process in this embodiment is the same as that of the above-mentioned third embodiment, and descriptions thereof will be omitted.

In this embodiment, since the inside of the opening 29 and the inner space 31 is at a negative pressure due to the evacuation of the air inside thereof, the tape seal 30 is not excessively expanded by the thermal expansion of the air in the opening 29 and the inner space 31. This results in prevention of the tape seal 30 from being peeled off from the top surface of the upper cap 23. Accordingly, the invasion of the cleaning liquid into the inner space 31 due to the peeling of the tape seal 30 is surely prevented.

A description will now be given, with reference to FIGS. 28 to 31, of a fifth embodiment of a manufacturing method of the switch 20 according to the present invention. In FIGS. 28 to 31, parts that are the same as the parts shown in FIG. 4 are given the same reference numerals, and descriptions thereof will be omitted.

Figure 28:
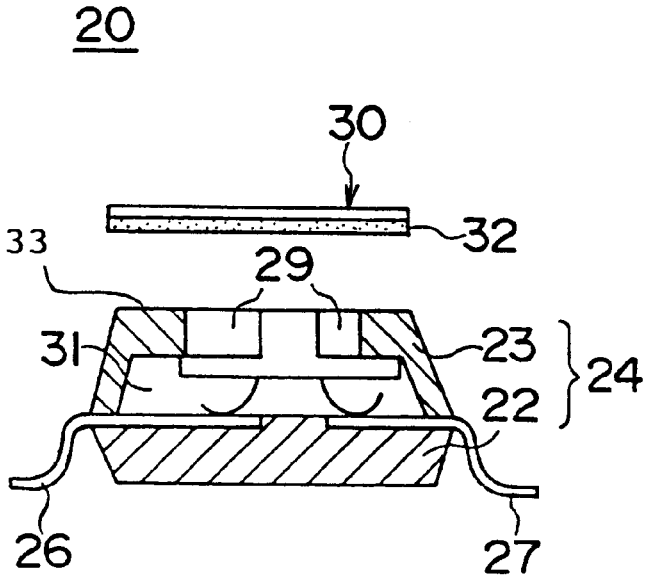
FIGS. 28 to 31 are views for explaining a fifth embodiment of a manufacturing method of the switch shown in FIG. 4.
Figure 29:
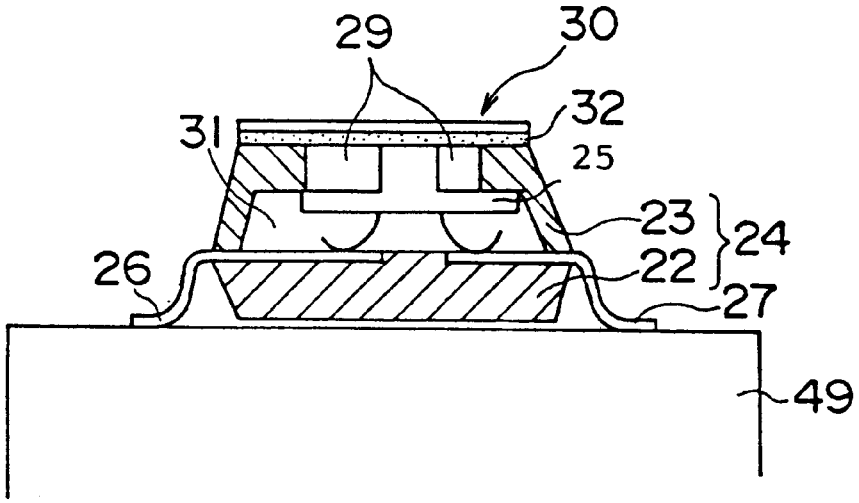

In this embodiment, the tape seal 30 is applied onto the top surface 33 of the upper cap 23 of the switch body 24 by the. same process as that of the above-mentioned third embodiment. FIG. 28 shows the tape seal applying process. The switch 20 having the tape seal 30 is then placed on a heat plate 49 as shown in FIG. 29 so as to apply a heating and sealing process.

Figure 30:
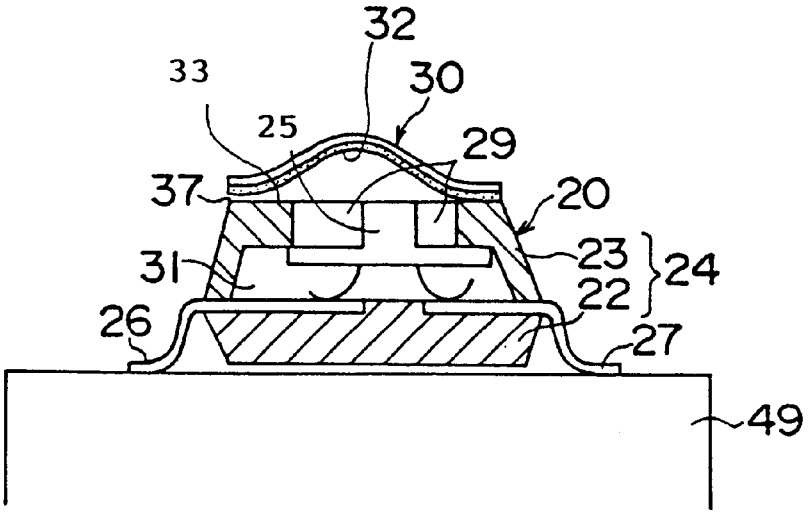
Figure 31:
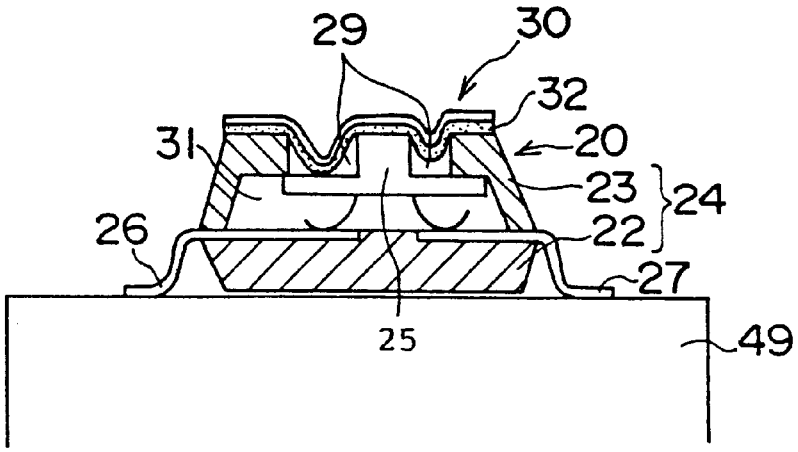

The heat plate 49 is, for example, an electric heater to heat the switch 20 so that the adhesive 32 applied to the tape seal 30 is cured. In this embodiment, unlike the previously mentioned embodiments, the switch 20 is not subjected to the evacuation process but processed under atmospheric pressure. That is, the switch 20 is heated by the heat plate 49 under atmospheric pressure. Since the air in the opening 29 and the inner space 31 is heated and expands, a portion of the tape seal 30 directly above the opening 29 expands. Eventually, a portion of the tape seal 30 is abruptly lifted or separated from the top surface 33 of the upper cap 23, and thus the air vent opening or the hole 37 is formed between the tape seal 30 and the upper cap 23 as shown in FIG. 30. Thus, the air in the opening 29 is abruptly discharged from the air vent opening or the hole 37. Accordingly, the lifted portion of the tape seal 30 adheres again to the top surface 33 of the upper cap 23, and thus the air vent opening or the hole 37 is closed as shown in FIG. 31. At this time, a negative pressure is temporarily generated in the opening 29 and the inner space 31 due to the abrupt discharge of the air in the opening 29 and the inner space 31. Additionally, the tape seal 30 has been expanded by the heat and the pressure inside the opening 29. Accordingly, the portion of the tape seal 30 directly above the opening 29 is recessed into the opening 29. Since the adhesive 32 is not completely cured yet, the tape seal 30 adheres onto the top surface 33 again by the adhesive 32. Thus, the opening 29 is hermetically sealed by the tape seal 30. The adhesive 32 is completely cured as the heating process is progressed.

In this embodiment, since the inside of the opening 29 and the inner space 31 is at a negative pressure due to the abrupt discharge of the air inside the opening 29 and the inner space 33, and thus the tape seal 30 directly above the opening 29 is drawn into the opening 29, the tape seal 30 is not excessively expanded by an expansion of the air in the opening 29 and the inner space 31. This prevents the tape seal 30 from being peeled off from the top surface of the upper cap 23 during the succeeding heating process such as the soldering process. Accordingly, the invasion of the cleaning liquid into the inner space 31 due to the peeling of the tape seal 30 is surely prevented.

As mentioned above, this embodiment does not use the evacuation process as applied in the previously mentioned embodiments, and thus the process for applying the tape seal 30 is simplified, and the construction of the tape applying apparatus is also simplified. This results in reduction of a manufacturing cost of the switch 20.

It should be noted that the above-mentioned embodiment is directed to apply the tape seal 30 to the surface-mountable switch 20. However, the present invention can be applied to other electric devices which are surface-mounted onto a circuit board.

The present invention is not limited to the specifically disclosed embodiments, and variations and modifications may be made without departing from the scope of the present invention.

What is claimed is:

1. A manufacturing method of a surface-mountable switch which is to be surface-mounted onto a circuit board by reflowing of solder, said surface-mountable switch comprising a switch body having a top surface and an inner space in which an electrical contact is provided, said inner space being communicated with an opening formed in said top surface, a switch knob which operates said electrical contact being accessed through said opening and a tape seal hermetically sealing said opening with a thermal curing type adhesive applied between said tape seal and said top surface of said switch body, a portion of said tape seal directly above said opening being drawn into said opening by a negative pressure in said opening and said inner space, said manufacturing method comprising the steps of:

a) applying said tape seal onto said top surface of said switch body to cover said opening so that said opening is temporarily sealed by said adhesive which has not been cured;

b) placing said switch body with said seal tape in a vacuum chamber; and c) evacuating air in said vacuum chamber while heating said tape seal and switch body that air in said opening and said inner space is evacuated through an opening temporarily formed between said tape seal and said top surface, said opening being closed immediately after the air in said opening and said inner space is evacuated.

2. A manufacturing method of a surface-mountable switch which is to be surface-mounted onto a circuit board by reflowing of solder, said surface-mountable switch comprising a switch body having a top surface and an inner space in which an electrical contact is provided, said inner space being communicated with an opening formed in said top surface, a switch knob which operates said electrical contact being accessed through said opening, and a tape seal hermetically sealing said opening with a pressure sensitive adhesive applied on said tape seal, a portion of said tape seal directly above said opening being drawn into said opening by a negative pressure in said opening and said inner space, said manufacturing method comprising the steps of:

a) applying said tape seal applied with said pressure sensitive adhesive onto said top surface of said switch body to cover said opening so that said opening is temporarily sealed by said pressure sensitive adhesive;

b) placing said switch body with said seal tape in a vacuum chamber;

c) evacuating air in said vacuum chamber so that air in said opening and said inner space is evacuated through an air vent opening temporarily formed between said tape seal and said top surface, said air vent opening closing immediately after the air in said opening and said inner space is evacuated; and d) pressing said tape seal against said top surface after the air in said opening and said inner space has been evacuated and while said switch body is in said vacuum chamber.

3. A manufacturing method of a surface-mountable switch which is to be surface-mounted onto a circuit board by reflowing of solder, said surface-mountable switch comprising a switch body having a top surface and an inner space in which an electrical contact is provided, said inner space being communicated with an opening formed in said top surface, a switch knob which operates said electrical contact being accessed through said opening, and a tape seal hermetically sealing said opening with a thermal curing type adhesive applied between said tape seal and said top surface of said switch body, a portion of said tape seal directly above said opening being drawn into said opening by a negative pressure in said opening and said inner space, said manufacturing method comprising the steps of:

a) applying said tape seal onto said top surface of said switch body to cover said opening so that said opening is temporarily sealed by said adhesive which has not been cured;

b) placing said switch body with said seal tape in a vacuum chamber;

c) evacuating air in said vacuum chamber so that air in said opening and said inner space is evacuated through an opening temporarily formed between said tape seal and said top surface, said opening closing immediately after the air in said opening and said inner space is evacuated;

d) inspecting whether or not the inside of said opening is maintained at a negative pressure so as to reject a switch body having said opening which is not maintained at the negative pressure; and e) curing said adhesive by applying heat so as to hermetically seal said opening.

4. The manufacturing method as claimed in claim 3, wherein the inspection of the step d) is performed by visually checking said portion of said tape seal directly above said opening as to whether or not said portion of said tape seal has returned flat.

5. A manufacturing method of a surface-mountable switch which is to be surface-mounted onto a circuit board by reflowing of solder, said surface-mountable switch comprising a switch body having a top surface and an inner space in which an electrical contact is provided, said inner space being communicated with an opening formed in said top surface, a switch knob which operates said electrical contact being accessed through said opening, and a tape seal hermetically sealing said opening with a thermal curing type adhesive applied between said tape seal and said top surface of said switch body, a portion of said tape seal directly above said opening being drawn into said opening by a negative pressure in said opening and said inner space, said manufacturing method comprising the steps of:

a) applying said tape seal onto said top surface of said switch body to cover said opening so that said opening is temporarily sealed by said adhesive which has not been cured;

b) placing said switch body with said seal tape in a vacuum chamber;

c) evacuating air in said vacuum chamber so that air in said opening and said inner space is evacuated through an opening temporarily formed between said tape seal and said top surface, said opening closing immediately after the air in said opening and said inner space has been evacuated;

d) pressing said tape seal against said top surface of said switch body so as to securely adhere said tape seal onto said top surface while said switch body is in said vacuum chamber; and e) curing said adhesive by applying heat under atmospheric pressure so as to hermetically seal said opening.

6. The manufacturing method as claimed in claim 5, wherein the said tape seal is pressed in the step d) by an elastic member which elastically deforms when pressed onto said tape seal so that said portion of said tape seal directly above said opening enters further into said opening.

7. A manufacturing method of a surface-mountable switch which is to be surface-mounted onto a circuit board by reflowing of solder, said surface-mountable switch comprising a switch body having a top surface and an inner space in which an electrical contact being provided, said inner space being communicated with an opening formed in said top surface, a switch knob which operates said electrical contact is accessed through said opening, and a tape seal hermetically sealing said opening with a thermal curing type adhesive applied between said tape seal and said top surface of said switch body, a portion of said tape seal directly above said opening being drawn into said opening by a negative pressure in said opening and said inner space, said manufacturing method comprising the steps of:

a) applying said tape seal onto said top surface of said switch body to cover said opening so that said opening is temporarily sealed by said adhesive which has not been cured;

b) heating said switch body so that said portion of said tape seal directly above said opening is inflated by expansion of air in said opening and said inner space, the air in said opening and said inner space being discharged through an air vent opening temporarily formed between said tape seal and said top surface of said switch body; and c) curing said adhesive by successively heating said switch body so as to hermetically seal said opening.

8. A manufacturing method of a switch which is to be mounted onto a circuit board, said switch comprising a switch body having a top surface and an opening formed in said top surface, said opening is sealed by a tape seal, said manufacturing method comprising the step of:

evacuating air in an inner space surrounded by said switch body and said tape seal so that said tape seal is drawn into said opening, and simulaneously heating the tape seal and switch body.

9. A manufacturing method of a switch which is to be mounted onto a circuit board, said switch comprising a switch body having a top surface and an opening formed in said top surface, said opening is sealed by a tape seal, said manufacturing method comprising the steps of:

applying a tape seal onto said top surface of said switch body so that said opening is sealed by said tape seal; and evacuating air in an inner space surrounded by said switch body and said tape seal so that said tape seal is drawn into said opening, and simultaneously heating the tape seal and switch body.

* * * * *